US010648116B2

(12) United States Patent
Bauman et al.

(10) Patent No.: US 10,648,116 B2
(45) Date of Patent: May 12, 2020

(54) LAUNDRY TREATING APPLIANCE LIFTER

(71) Applicant: WHIRLPOOL CORPORATION, Benton Haror, MI (US)

(72) Inventors: Michael J. Bauman, Saint Joseph, MI (US); Scott E. Carpenter, Wanatah, IN (US); Peter N. Howes, Saint Joseph, MI (US); Nicholas Leep, Saint Joseph, MI (US); Lindsey A. Wohlgamuth, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 196 days.

(21) Appl. No.: 15/719,682

(22) Filed: Sep. 29, 2017

(65) Prior Publication Data

US 2019/0100865 A1 Apr. 4, 2019

(51) Int. Cl.
*D06F 37/06* (2006.01)
*D06F 37/14* (2006.01)

(52) U.S. Cl.
CPC ..... *D06F 37/065* (2013.01); *D06F 37/06* (2013.01); *D06F 37/14* (2013.01)

(58) Field of Classification Search
None
See application file for complete search history.

(56) References Cited

U.S. PATENT DOCUMENTS

| | | | | |
|---|---|---|---|---|
| 1,389,182 | A | 8/1921 | Binder | |
| 5,115,651 | A | 5/1992 | Nukaga et al. | |
| 6,021,536 | A | 2/2000 | Wasinger et al. | |
| D773,763 | S * | 12/2016 | Hwang | D32/29 |
| 2005/0204783 | A1* | 9/2005 | Kim | D06F 37/06 68/3 R |
| 2007/0295035 | A1* | 12/2007 | Lim | D06F 37/04 68/3 R |
| 2012/0160281 | A1 | 6/2012 | Hashimoto et al. | |
| 2012/0180532 | A1 | 7/2012 | Park et al. | |
| 2013/0081432 | A1* | 4/2013 | Choi | D06F 37/06 68/142 |
| 2015/0007395 | A1* | 1/2015 | Kim | D06F 37/065 8/137 |

FOREIGN PATENT DOCUMENTS

| | | |
|---|---|---|
| EP | 2546403 A1 | 1/2013 |
| FR | 1535336 A | 8/1968 |
| GB | 219757 A | 8/1924 |
| WO | DM/088 818 | 8/2015 |

OTHER PUBLICATIONS

European Search Report for Counterpart EP181976176, dated Jan. 7, 2019.

* cited by examiner

*Primary Examiner* — Cristi J Tate-Sims
(74) *Attorney, Agent, or Firm* — McGarry Bair PC

(57) ABSTRACT

A laundry treating appliance having a tub with a tub interior that defines a liquid chamber, a rotatable drum located within the liquid chamber and rotatable about a rotational axis that at least partially defines a treating chamber, and a lifter housing carried by the drum and located within the treating chamber.

20 Claims, 4 Drawing Sheets

LAUNDRY TREATING APPLIANCE LIFTER

BACKGROUND

Laundry treating appliances, such as clothes washers, refreshers, and non-aqueous systems, can have a configuration based on a rotating drum that defines a treating chamber in which laundry items are placed for treating. The drum may include one or more lifters located along the inner surface of the drum. The lifters can facilitate movement and cleaning of the laundry within the drum as the drum rotates. Lifters can impart damage onto laundry items as they facilitate cleaning.

BRIEF SUMMARY

In one aspect, a laundry treating appliance includes a tub having a tub interior defining a liquid chamber, a rotatable drum located within the liquid chamber and rotatable about a rotational axis, and at least partially defining a treating chamber, and a lifter housing carried by the drum comprising an elongated body having an outer surface and located within the treating chamber, the outer surface having a plurality of spaced grooves extending longitudinally along the elongated body and having a flat and uniform width between each groove.

In another aspect, a laundry treating appliance includes a tub having a tub interior defining a liquid chamber, a rotatable drum located within the liquid chamber and rotatable about a horizontal axis, a lifter secured to the drum and adapted to lift the laundry in the drum by upward rotation of the drum, where the lifter includes a lifter housing having at least one outer surface with a plurality of uniformly spaced grooves in the side along the length of the lifter and defining a width between each groove, where the width between each groove is substantially proportional to the width of the groove.

DETAILED DESCRIPTION

Aspects of the present disclosure relate to a laundry treating appliance having a tub that contains an interior defining a liquid chamber, a rotatable drum within the liquid chamber and a lifter inside the drum that is configured to lift laundry in the drum by upward rotation of the drum.

The lifter includes grooves that allow for the laundry treating appliance to obtain about the same cleaning scores as when using larger lifters while increasing the gentleness on the laundry according to evaluations performed using the Association of Home Appliance Manufacturers Performance Evaluation Procedures for Household Clothes Washers (AHAM HLW-1-2013). Typically, cleaning scores and gentleness are inversely related such that as cleaning scores rise, gentleness drops. The presence of the grooves on the lifter and its geometry allow for a smaller, lower profile lifter that can clean as well as a larger lifter, yet be gentler on laundry items.

Figure 1:
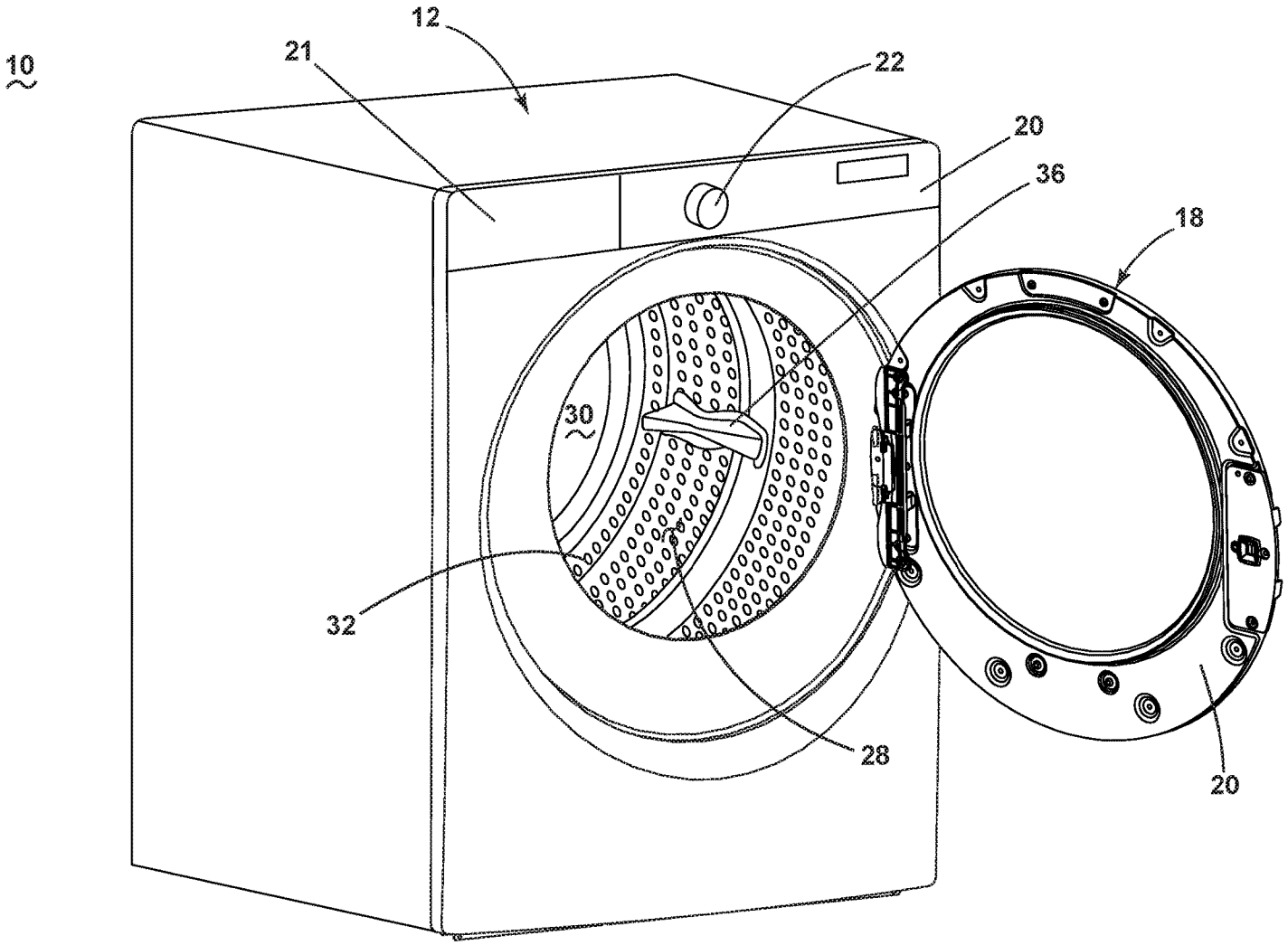
FIG. 1 is a perspective of a laundry treating appliance in the form of a washing machine having a lifter according to aspects of the present disclosure.

By way of overview, FIG. 1 is an illustrative example of a laundry treating appliance that can be any appliance that performs a cycle of operation to clean or otherwise treat items placed therein. The laundry treating appliance is illustrated as a horizontal axis washing machine 10, which can include a cabinet 12 for housing the operational parts of the machine, together with a hinged door 18. A console 21 having a control panel 20 which includes the operating controls 22 for the washer is illustrated on the upper, front of the cabinet 12, but can be located elsewhere. Housed within the cabinet 12 is a wash tub supported by a suitable suspension system. A drum 28 can be provided within the tub and defines at least a portion of a treating chamber 30 in which the laundry is treated. The drum 28, located within the liquid chamber, can generally rotate about a horizontal axis and holds the laundry during operation of the washing machine 10. The drum 28 may include a plurality of perforations 32 such that liquid may flow between the tub and the drum 28 through the perforations 32. The drum 28 comprises an inner circumferential surface to which one or more lifters 36 can be secured. The lifters 36 lift the laundry load received in the treating chamber 30 by upward rotation of the drum 28.

Conventional washing machine components are not described in detail, but are described briefly as needed to provide an illustrative environment to support a complete understanding of aspects of the present disclosure.

Figure 2:
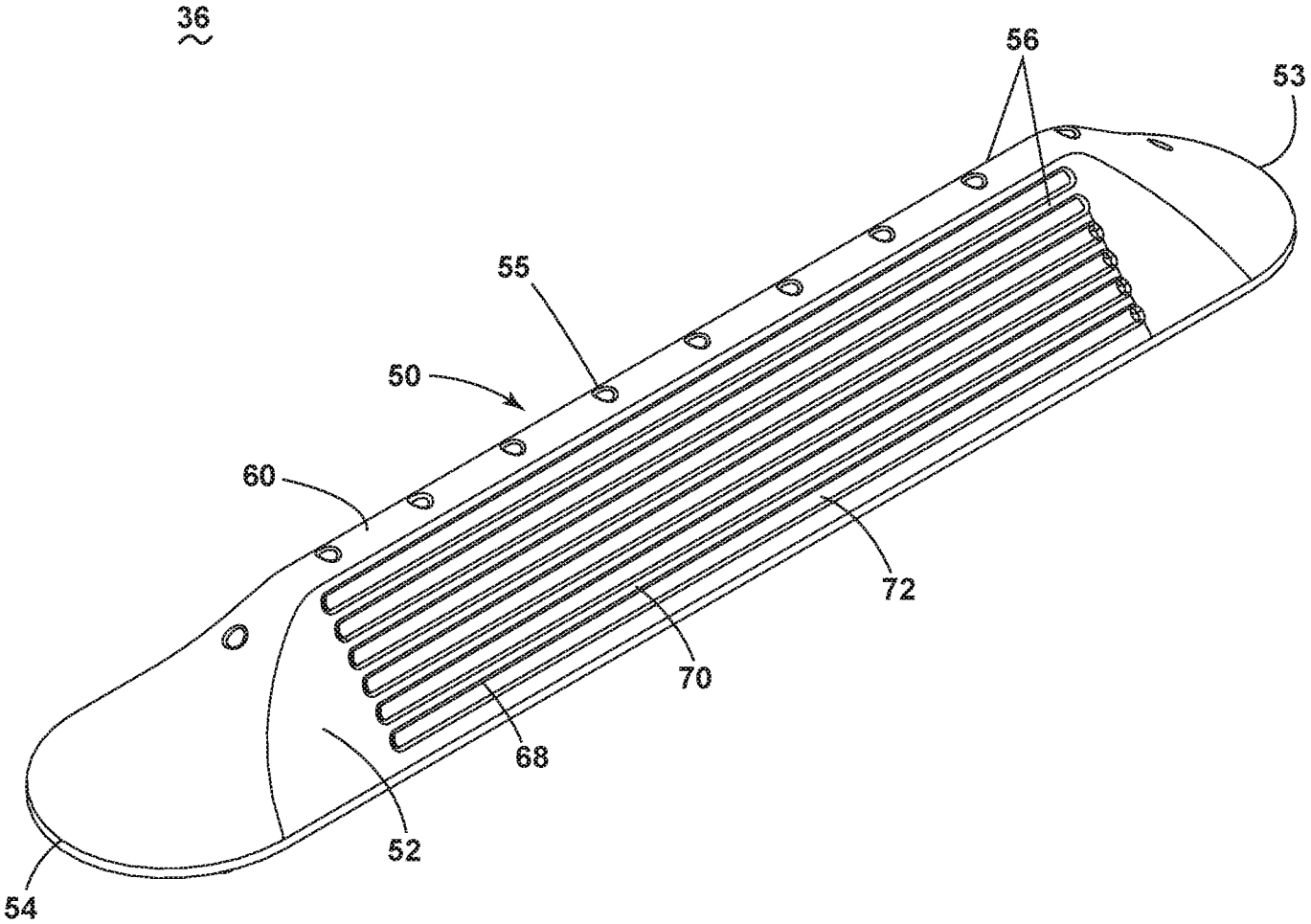
FIG. 2 is a perspective view of an exemplary lifter of the laundry treating appliance of FIG. 1 according to aspects of the present disclosure.

Referring to FIG. 2 as an illustrative example of a lifter of the laundry treating appliance of FIG. 1 according to aspects of the present disclosure, the lifter 36 can comprise a lifter housing 50 carried by the drum 28 during rotation of the drum 28. The lifter housing 50 comprises an elongated body 52 and opposing end elements 53, 54, and a plurality of spaced apart drain holes 55 to allow for any wash liquid that could accumulate inside the lifter housing 50 during a cycle of operation to be expelled or drained from the lifter housing 50. The lifter housing 50 can comprise plastic, such as polypropylene, stainless steel, or any other suitable material that can withstand the interior conditions of the liquid chamber of a laundry treating appliance such as washing machine 10.

The elongated body 52 comprises a pair of spaced apart outer surfaces 56 that form the sides along the length of the elongated body 52. The pair of outer surfaces 56 can be angled toward each other and coupled together by a top 60. The opposing end elements 53, 54 are integral with the outer surfaces 56 and the top 60 of the elongated body 52 to define the lifter housing 50. While the illustration shows the elongated body 52 having a symmetrical cross-section relative to its longitudinal axis, the body 52 could be formed with outer surfaces 56 having different widths, thus creating an unequal or asymmetrical cross-section.

In one aspect of the present disclosure, the outer surfaces 56 can be straight while the top 60 is rounded such that the cross-section of the elongated body 52 relative to its longitudinal axis is generally triangular in shape. In another aspect of the present disclosure, the outer surfaces 56 can be straight while the top 60 is substantially square such that the cross-section of the elongated body 52 relative to its longitudinal axis is mostly triangular in shape with a substantially squared-off apex. It should be recognized that the outer surfaces 56 could also by slightly concave or convex, or a combination thereof, without departing from the scope of the disclosure. Furthermore, the opposing end elements 53, 54 can be curved, square, straight, squared-off with curved edges, or any other shape that can be suitably secured to the drum 28.

The outer surface 56 can comprise a plurality of uniformly spaced apart grooves 68 that extend longitudinally along the elongated body 52. The grooves 68 can be arranged in parallel along the length of the elongated body 52 such that a space between one groove 68 and the next groove 68 defines a width 70 that is substantially proportional to an interior width 72 of the groove 68 itself. The grooves 68 can have a concave shape, such as a U-shaped, interior section and can comprise a curved or straight end at one or both of their terminal longitudinal lengths. Alternatively, the grooves 68 can comprise a less annular shape, such as a V-shape or rectangular cross-sectional shape, in the interior section. The width 70 between each groove is flat and uniform and can be more than, less than, or equal to the interior width 72 of the groove 68.

Figure 3:
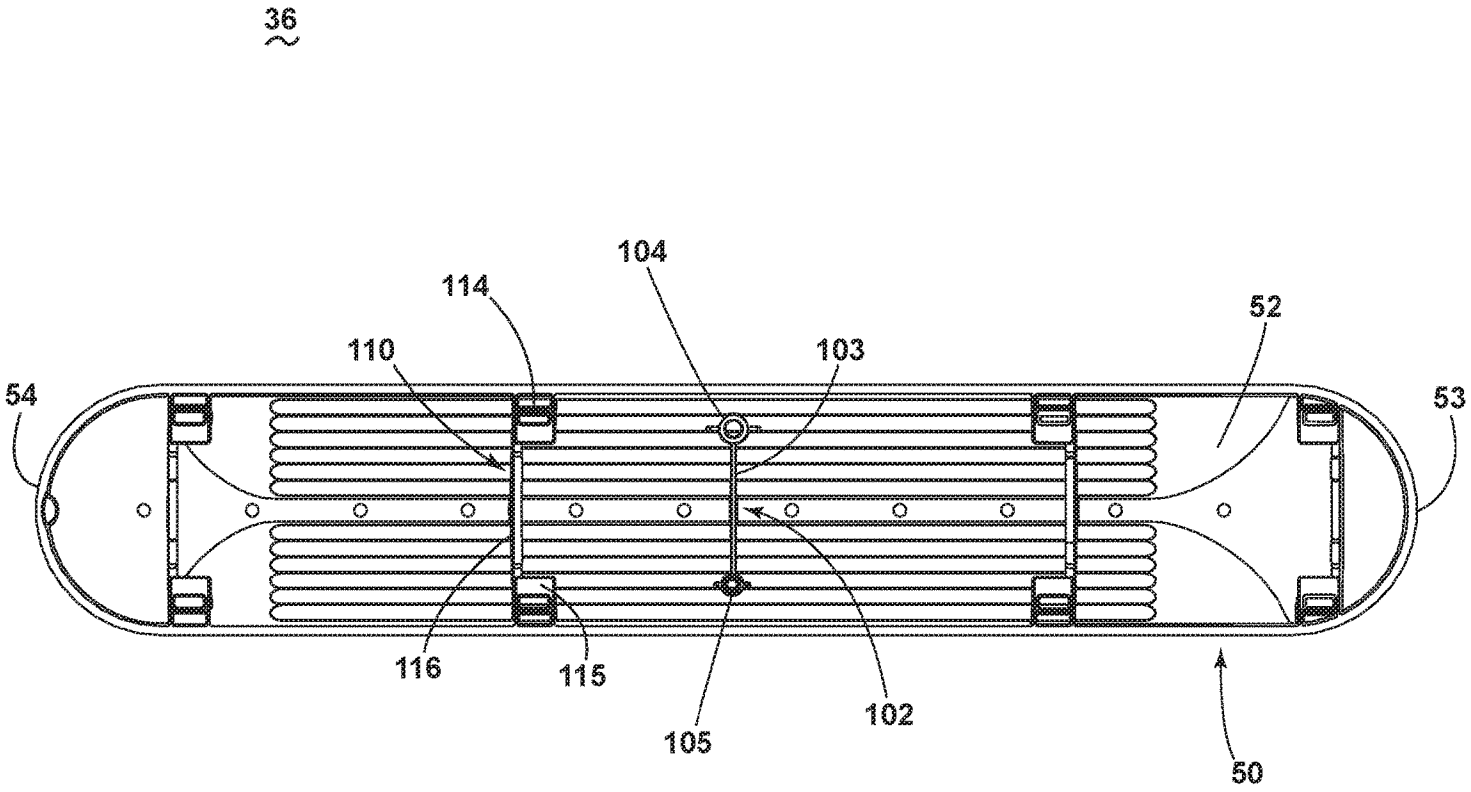
FIG. 3 is a bottom view of the lifter of FIG. 2 according to aspects of the present disclosure.

FIG. 3 is a bottom view of an exemplary lifter of the laundry treating appliance of FIG. 1 according to aspects of the present disclosure. The lifter housing 50 can comprise one or more coupling elements 102 for receiving one or more coupling mechanisms located on the circumferential surface of the drum 28 to couple the lifter housing 50 to the drum 28. In more detail, the coupling element 102 can comprise post-receiving elements 104 and 105 in a spaced apart relationship separated by a crosspiece 103 therebetween. Crosspiece 103 can be a structural support rib that provides bracing and/or rigidity to the lifter housing 50. Each of the post-receiving elements 104 and 105 can receive an opposing post (not shown) from the drum 28 to connect the lifter housing 50 to the drum 28 through a snap-fit connection and prevent forward to aft movement and shifting of the lifter 26 during operation of the washing machine 10 It should be recognized that coupling elements 102 can comprise any snap-fit mechanism, slide-lock mechanism, or other coupling means to connect the lifter housing 50 to the drum 28 without departing from the scope of the disclosure.

The lifter housing 50 can further comprise one or more engagement elements 110 that can be coupled to an opposing receiver located on the circumferential surface of the drum 28 to connect the lifter housing 50 to the drum 28 and prevent side-to-side motion of the lifter 36 in the drum 28 during operation of the washing machine 10. In more detail, the engagement elements 110 comprise P-shaped tabs 114 and 115 in a spaced apart relationship separated by a crosspiece 116 therebetween. Crosspiece 116 can be a structural support rib that provides bracing and/or rigidity to the lifter housing 50. Each P-shaped tab 114 and 115 can pilot into an opposing receiving slot (not shown) provided on the drum 28 to form a slide-lock connection to connect the lifter housing 50 to the drum 28 and prevent side-to-side movement and shifting of the lifter 36 during operation of the washing machine 10. While the illustration shows four sets (four on each side of the inner surface of each outer surface 56) of P-shaped tabs, more or fewer tabs could be used. Also, as should be recognized, other types of engagement elements 110 such as snap-fit or slide-lock mechanism could be used.

Figure 4:
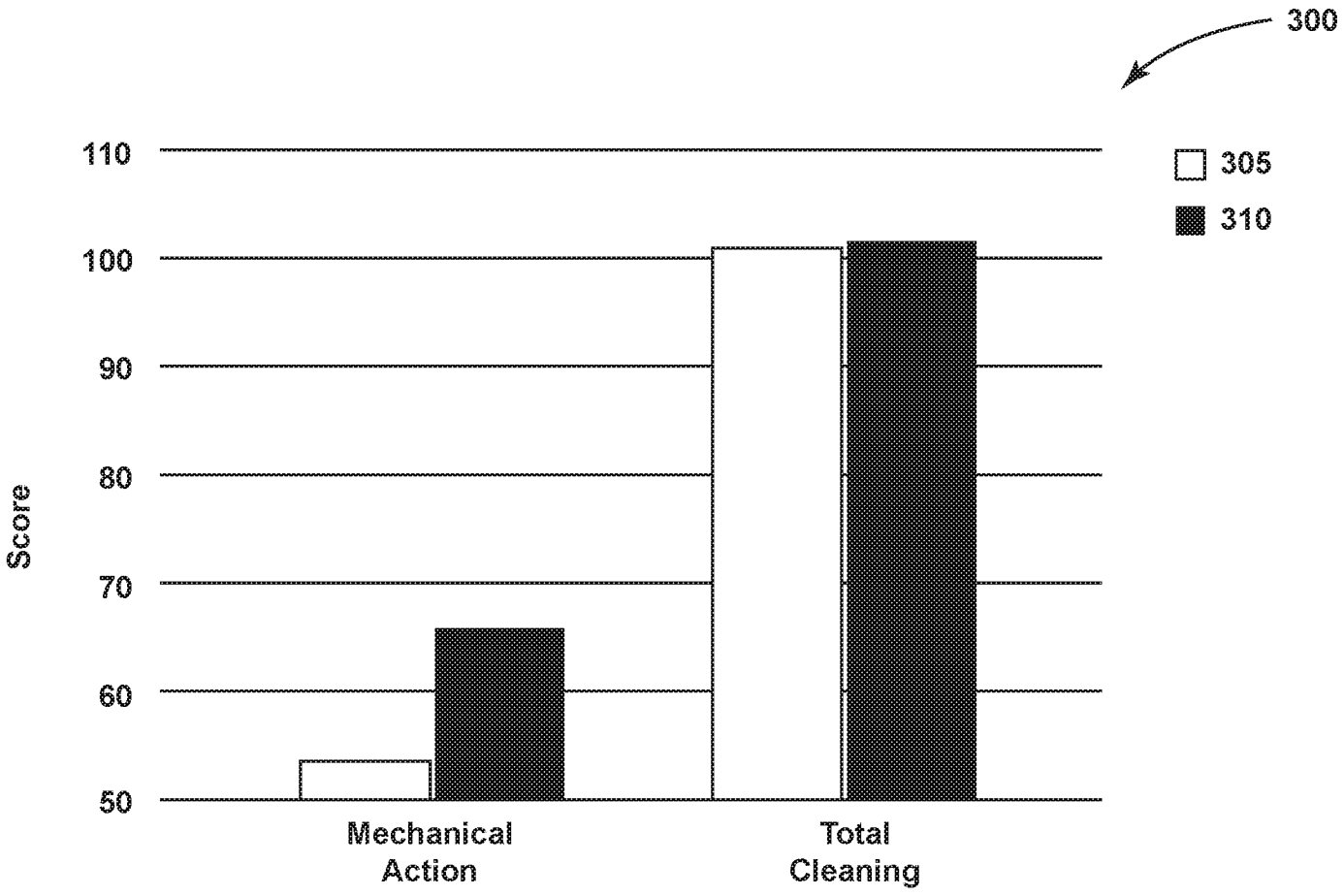
FIG. 4 is an illustrative bar graph comparing a mean mechanical action score and mean total cleaning score of a traditional lifter vs. a lifter according to aspects of the present disclosure.

Benefits of aspects described herein can include a smaller, lower profile lifter that is gentler on laundry yet can clean laundry as well as a traditional, larger, more fabric damaging lifter configuration. FIG. 4 is an illustrative bar graph comparing the mean mechanical action (gentleness) score and mean total cleaning score of a traditional lifter vs. a lifter according to aspects of the present disclosure. The scores were generated by evaluations performed using the Association of Home Appliance Manufacturers Performance Evaluation Procedures for Household Clothes Washers (AHAM HLW-1-2013). Mechanical Action scores are indicative of how gentle a machine treats fabrics during a wash cycle. In aspects of the present disclosure, a lower mechanical action score indicates a higher 'gentleness' to the laundry. Typically, cleaning scores and gentleness on fabrics are inversely related such that as mechanical action rises, in turn, cleaning scores rise, and gentleness to the laundry drops. The lifter described herein can disrupt that inverse relationship by facilitating the same level of cleaning while increasing gentleness to the laundry by decreasing damage to the laundry through mechanical action.

In FIG. 4, a bar graph 300 illustrates the mean mechanical action score of a lifter 305 according to aspects of the present disclosure vs. a traditional lifter 310. In the bar graph 300, the lifter 305 has a mean mechanical action score of 54, while the traditional lifter 310 has a mean mechanical action score of 66, indicating that the lifter 305 is gentler to a laundry load than a traditional lifter 310. Bar graph 300 further illustrates the total cleaning score of the lifter 305 vs. the traditional lifter 310. In the bar graph 300, the lifter 305 has a mean total cleaning score of 101.8 while the traditional lifter 310 has a mean total cleaning score of 102.5, illustrating that the total cleaning scores of the lifter 305 and the traditional lifter 310 are similar. The bar graph 300 illustrates that the lifter 305 and the traditional lifter 310 can have similar total cleaning scores, however, the lifter 305 is gentler on laundry as illustrated by the lower mean mechanical action score of the lifter 305.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance, comprising:

a tub having a tub interior defining a liquid chamber;

a rotatable drum located within the liquid chamber and rotatable about a rotational axis, and at least partially defining a treating chamber; and a lifter housing carried by the drum comprising an elongated body having a stationary outer surface and located within the treating chamber, the outer surface having a plurality of spaced grooves protruding into an interior of the lifter housing, with closed cross-sectional profiles, extending longitudinally along a length of the elongated body and having a flat and uniform width between each groove.

2. The laundry treating appliance of claim 1 wherein the drum further comprises an inner circumferential surface to which the lifter housing is secured.

3. The laundry treating appliance of claim 2 further comprising at least one post connecting the lifter housing to the drum to prevent forward to aft motion of the lifter housing.

4. The laundry treating appliance of claim 3 wherein the at least one post snap fits in to an opposing post-receiving element on the lifter housing.

5. The laundry treating appliance of claim 2 further comprising at least one tab connecting the lifter housing to the drum to prevent side-to-side motion of the lifter housing.

6. The laundry treating appliance of claim 5 wherein the at least one tab snap fits in to an opposing receiver in the drum.

7. The laundry treating appliance of claim 1 wherein at least some of the spaced grooves are parallel.

8. The laundry treating appliance of claim 7 wherein at least some of the spaced grooves are concave.

9. The laundry treating appliance of claim 1 wherein the elongated body has a triangular cross section.

10. The laundry treating appliance of claim 9 wherein the elongated body has a symmetrical cross-section relative to a longitudinal axis of the elongated body.

11. The laundry treating appliance of claim 10 wherein the outer surface is one of straight or concave.

12. The laundry treating appliance of claim 1 where the lifter housing comprises plastic or stainless steel.

13. A laundry treating appliance, comprising:

a tub having a tub interior defining a liquid chamber;

a rotatable drum located within the liquid chamber; and a lifter secured to the drum and adapted to lift laundry in the drum by upward rotation of the drum, wherein the lifter comprises:

a lifter housing having at least one stationary outer surface with a plurality of uniformly spaced grooves protruding into an interior of the lifter housing, with closed cross-sectional profiles, along a length of the lifter and defining a flat width between each groove; wherein the width between each groove is less than the width of adjacent grooves.

14. The laundry treating appliance of claim 13 wherein the drum further comprises an inner circumferential surface to which the lifter housing is secured.

15. The laundry treating appliance of claim 14 further comprising at least one post connecting the lifter housing to the drum to prevent forward to aft motion of the lifter housing.

16. The laundry treating appliance of claim 14 further comprising at least one tab connecting the lifter housing to the drum to prevent side-to-side motion of the lifter housing.

17. The laundry treating appliance of claim 16 wherein at least one tab snap fits in to an opposing receiver in the drum.

18. The laundry treating appliance of claim 13 wherein a pair of outer surfaces defines the lifter housing.

19. The laundry treating appliance of claim 18 wherein the pair of outer surfaces are spaced apart and angled toward each other.

20. The laundry treating appliance of claim 18 further comprising a rounded top coupling the pair of outer surfaces.

* * * * *